US011220832B2

(12) United States Patent
Meynelly

(10) Patent No.: US 11,220,832 B2
(45) Date of Patent: Jan. 11, 2022

(54) ADJUSTABLE SEAT DEVICE FOR A SWIMMING POOL

(71) Applicant: JUMEY, Lunel-Viel (FR)

(72) Inventor: Julien Meynelly, Lunel-Viel (FR)

( * ) Notice: Subject to any disclaimer, the term of this patent is extended or adjusted under 35 U.S.C. 154(b) by 0 days.

(21) Appl. No.: 16/970,385

(22) PCT Filed: Mar. 25, 2019

(86) PCT No.: PCT/FR2019/050674
§ 371 (c)(1),
(2) Date: Aug. 17, 2020

(87) PCT Pub. No.: WO2019/186043
PCT Pub. Date: Oct. 3, 2019

(65) Prior Publication Data
US 2020/0407994 A1 Dec. 31, 2020

(51) Int. Cl.
*E04H 4/14* (2006.01)

(52) U.S. Cl.
CPC ..... *E04H 4/14* (2013.01)

(58) Field of Classification Search
CPC ..... A63B 2022/0635; A63B 69/16; A63B 2210/02; A63B 2225/60; A47C 3/28; A47C 9/002; A47C 9/022
See application file for complete search history.

(56) References Cited

U.S. PATENT DOCUMENTS 2,709,560 A * 5/1955 Resk ..... F16M 11/08 248/169
5,050,863 A * 9/1991 Yacoboski ..... A63B 21/00047 482/55
5,354,253 A * 10/1994 Awbrey ..... A63B 1/00 482/111
5,868,649 A * 2/1999 Erickson ..... A63B 21/0084 482/58
2008/0092285 A1* 4/2008 Petersen ..... E04H 4/14 4/496
2016/0367034 A1* 12/2016 Johnston ..... A47C 9/022

* cited by examiner

*Primary Examiner* — Janie M Loeppke
(74) *Attorney, Agent, or Firm* — Patshegen IP LLC; Moshe Pinchas

(57) ABSTRACT

The invention relates to an adjustable seat device (10) that includes:

a linear support (38);

at least one upper bearing means of the linear support configured to bear on a horizontal surface at the edge of a swimming pool and at least one lower bearing means of the linear support configured to bear on an inner wall of the swimming pool;

a seat (28);

an upper seat rod (36), having one end provided with
- a first seat slide (29) configured to slide along the linear support and
- a locking means (30) for locking the first slide in position on the linear support;

a lower seat rod (37), having one end provided with
- a second seat slide (31) configured to slide along the linear support and
- a locking means (32) for locking the second slide in position on the linear support, the two seat rods jointly supporting the seat and being connected to one another by a swivel link (35).

The seat slides slide independently along the linear support, the joint sliding of the seat slides adjusting the height of the seat and the respective sliding of the seat slides adjusting at least the separation between the seat and the linear support.

10 Claims, 8 Drawing Sheets

ADJUSTABLE SEAT DEVICE FOR A SWIMMING POOL

TECHNICAL FIELD

The invention relates to an adjustable seat device, in particular for swimming pools. It applies to the field of swimming pool accessories.

STATE OF THE ART

Seats or bicycles for installing on the bottom of swimming pools for relaxing or exercising, are known. However, these seats and bicycles are heavy and difficult to install and remove. In addition, they are unsuitable for swimming pools with a sloping bottom, and adjusting their seat height is complicated, especially when the swimming pool's depth varies from place to place.

DESCRIPTION OF THE INVENTION

The present invention aims to remedy all or part of these drawbacks.

To this end, according to a first aspect, the present invention envisages an adjustable seat device, which comprises:

- a linear support;
- at least one upper bearing means of the linear support configured to bear on a horizontal surface at the edge of a swimming pool and at least one lower bearing means of the linear support configured to bear on an inner wall of the swimming pool;
- a seat;
- an upper seat rod, having one end provided with
  - a first seat slide configured to slide along the linear support and
  - a locking means for locking the first slide in position on the linear support;
- a lower seat rod, having one end provided with
  - a second seat slide configured to slide along the linear support and
  - a locking means for locking the second slide in position on the linear support, the two seat rods jointly supporting the seat and being connected to each other by a swivel link, such that the seat slides slide independently along the linear support, the joint sliding of the seat slides adjusting the height of the seat and the respective sliding of the seat slides adjusting at least the separation between the seat and the linear support.

Thanks to these provisions, by positioning each upper bearing means on the edge of the swimming pool and each lower bearing means against an inner wall of the swimming pool, one has a seat in the swimming pool which is at a constant depth, regardless of the depth of the swimming pool. In addition, by sliding the seat slides along the linear support and then locking them in position, the height of the seat and its separation from the linear support, and therefore from the inner wall of the swimming pool, are adjusted. The user can therefore sit in the swimming pool to relax or exercise.

In some embodiments, the linear support comprises openings which the locking means snap into.

Thanks to these provisions, the position of each locking means and therefore of the slides is robustly ensured.

In some embodiments, each bearing means comprises an articulation of a foot.

Thanks to these provisions, the feet can be adjusted for the corners or curved walls of swimming pools. In this way, the seat device of the invention can be adapted to any swimming pool portion and shape.

In some embodiments, the seat device comprises a foldable shelf.

Thanks to these provisions, the user can support and use a book, magazine or computer terminal, for example a mobile telephone, tablet computer or laptop, without this book, magazine or terminal being in contact with the possibly wet or dirty ground.

In some embodiments, the device comprises two armrests, each armrest being borne by:

- an upper armrest rod, having one end provided with
  - a first armrest slide configured to slide along the linear support and
  - a locking means for locking the first slide in position on the linear support;
- a lower armrest rod, having one end provided with
  - a second armrest slide configured to slide along the linear support and
  - a locking means for locking the second slide in position on the linear support, the two armrest rods being connected to each other by a swivel link, such that the armrest slides slide independently along the linear support, the joint sliding of the armrest slides adjusting the height of the armrest and the respective sliding of the armrest slides adjusting at least the separation between the armrest and the linear support.

Thanks to these provisions, the user can put weight on the armrests and adjust their separation and height.

In some embodiments, the device comprises a pedal unit borne by the linear support.

Thanks to these provisions, the user can perform aquabiking exercises.

In some embodiments, the device comprises a single lower bearing means of the linear support on the wall of the swimming pool.

Thanks to these provisions, the lower bearing means does not hinder the operation of the pedal unit.

In some embodiments, the linear support comprises an upper handle for transporting the device.

Thanks to these provisions, the device is easily positioned in or removed from the swimming pool by taking hold of the handle.

In some embodiments, the device comprises a footrest fixed to the linear support.

Thanks to these provisions, the user's seat is more comfortable and stable.

In some embodiments, at least one element of the assembly consisting of the linear support and the rods is a hollow tube, each hollow tube being provided with an upper opening and a lower opening.

Thanks to these provisions, the water does not remain in the tubes making up the device, which reduces its weight and prevents corrosion and the growth of microorganisms.

BRIEF DESCRIPTION OF THE FIGURES

Other advantages, aims and characteristics of the present invention will become apparent from the description that will follow, made, as an example that is in no way limiting, with reference to the drawings included in an appendix, wherein.

DESCRIPTION OF EMBODIMENTS OF THE INVENTION

Figure 1:
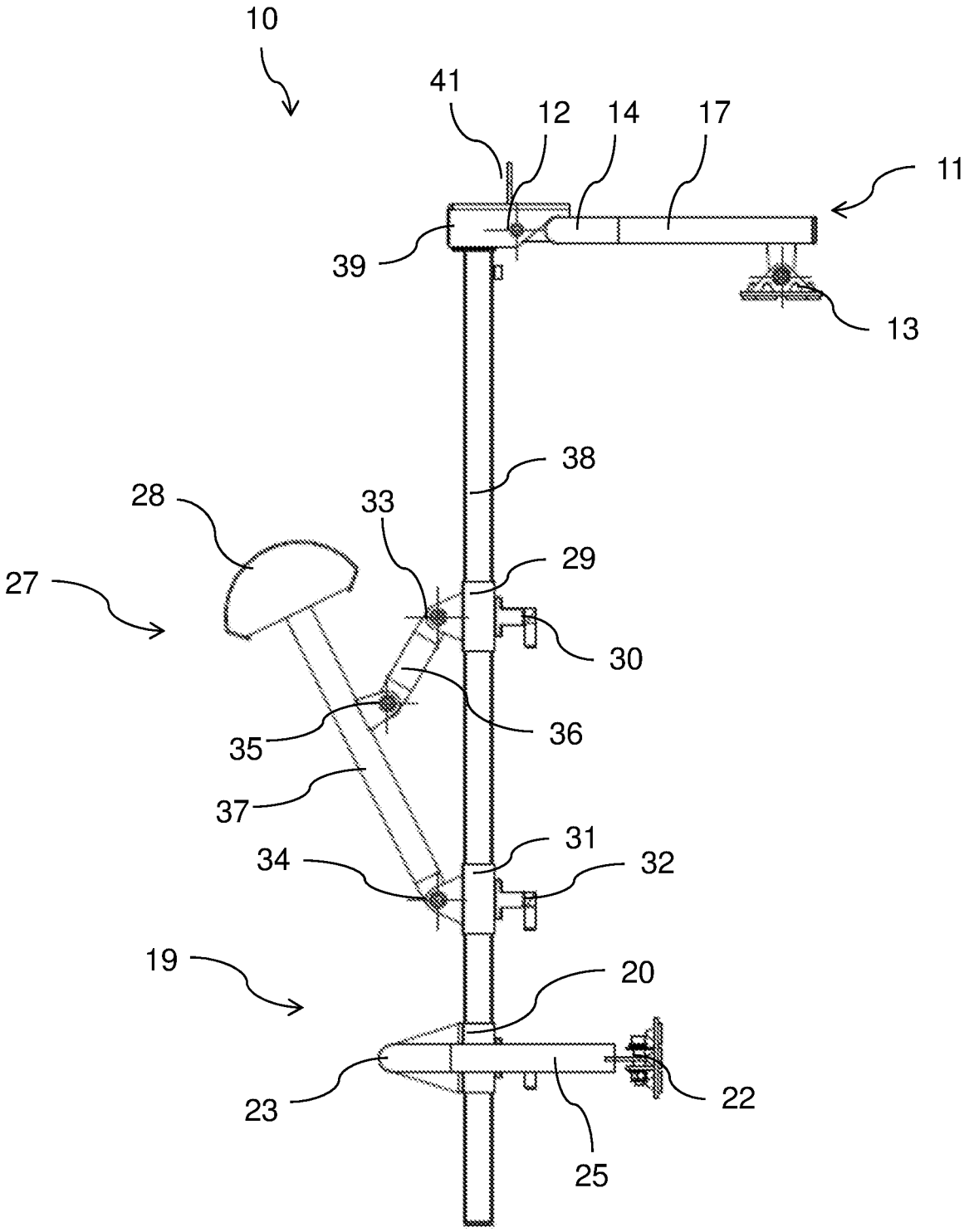
FIG. 1 represents, schematically and in a side view, a first particular embodiment of the seat device that is the subject of the invention.
Figure 2:
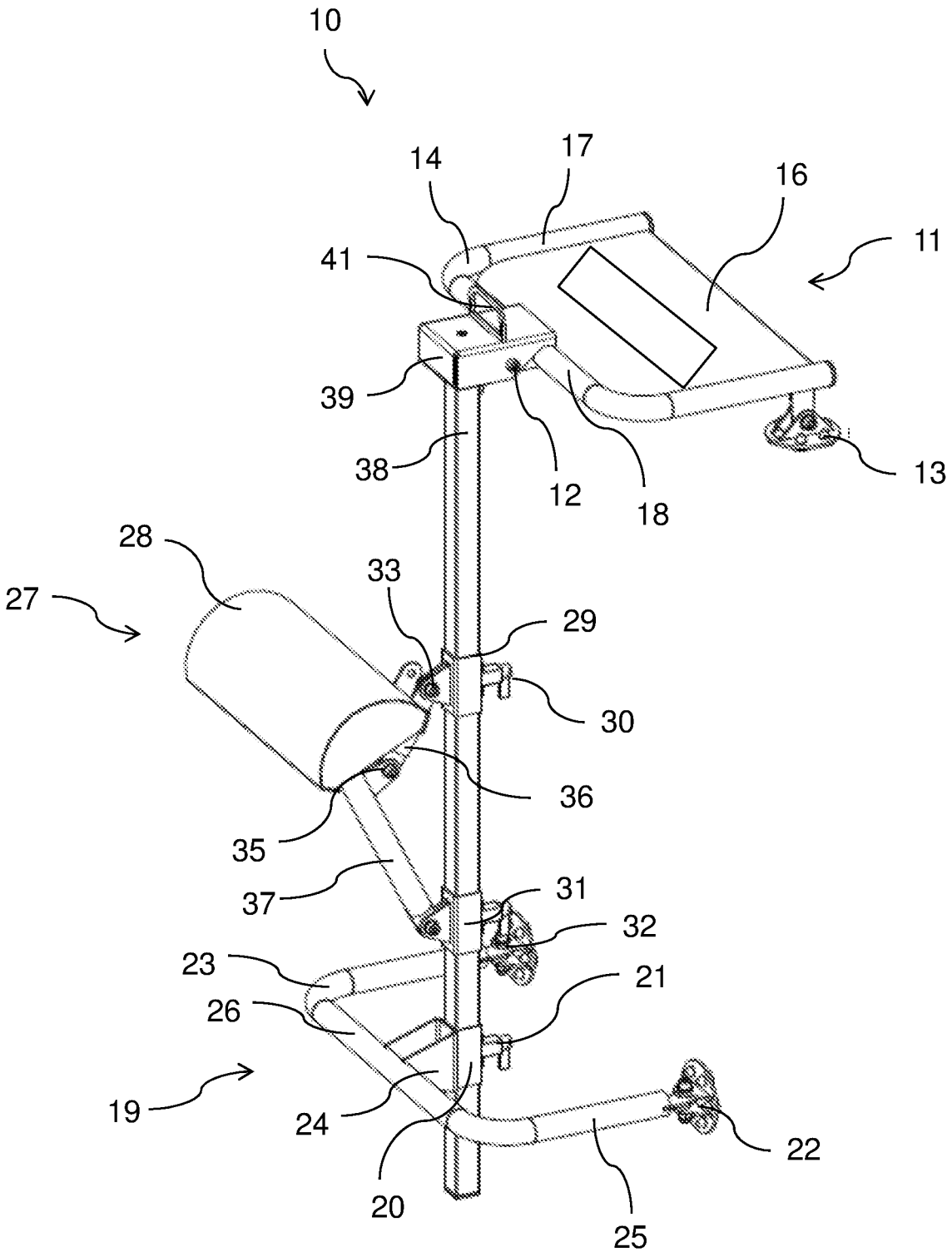
FIG. 2 represents, in perspective, the device shown in FIG. 1.
Figure 3:
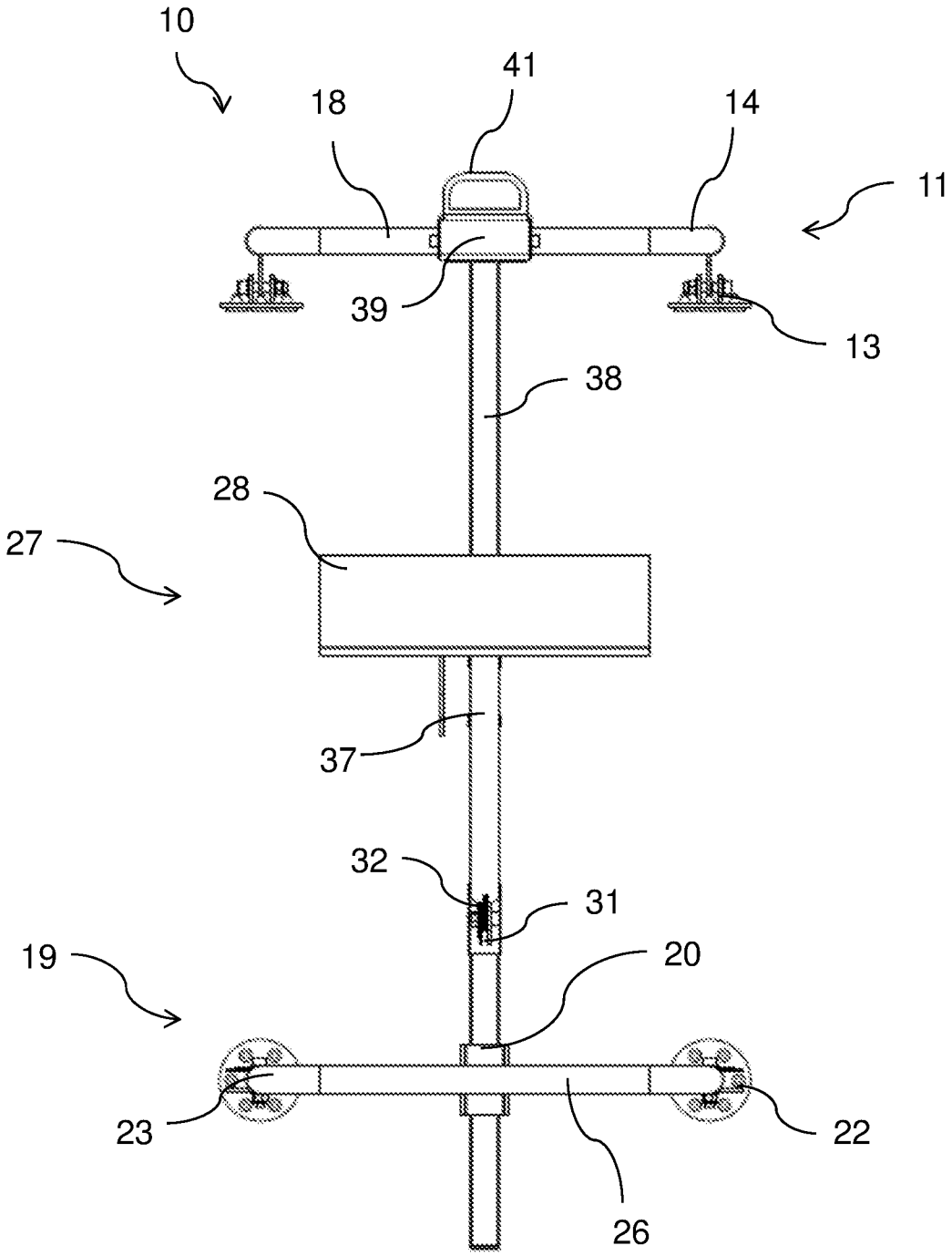
FIG. 3 represents, in a front view, the device shown in FIGS. 1 and 2.
Figure 4:
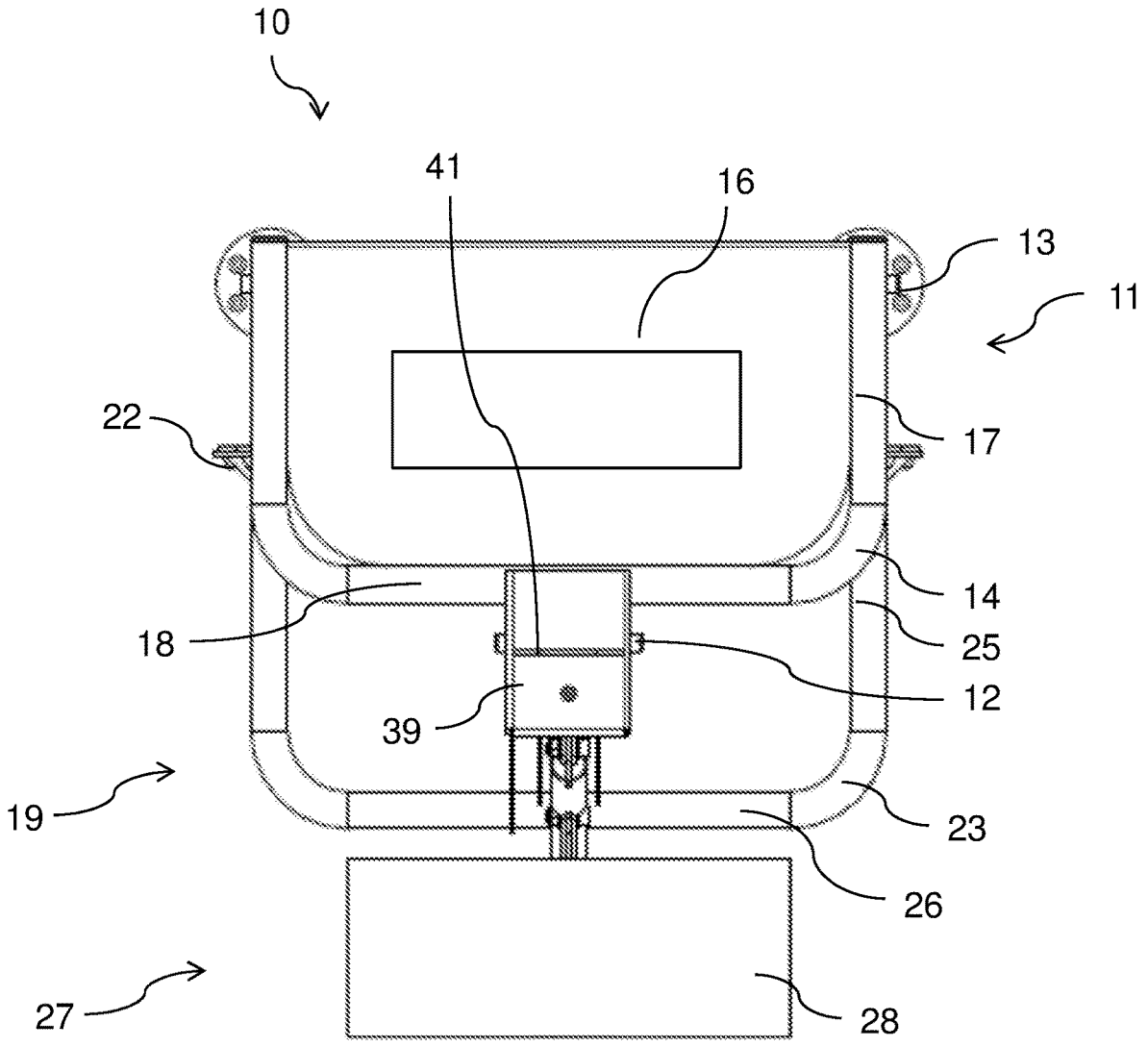
FIG. 4 represents, in a top view, the device shown in FIGS. 1 to 3.
Figure 5:
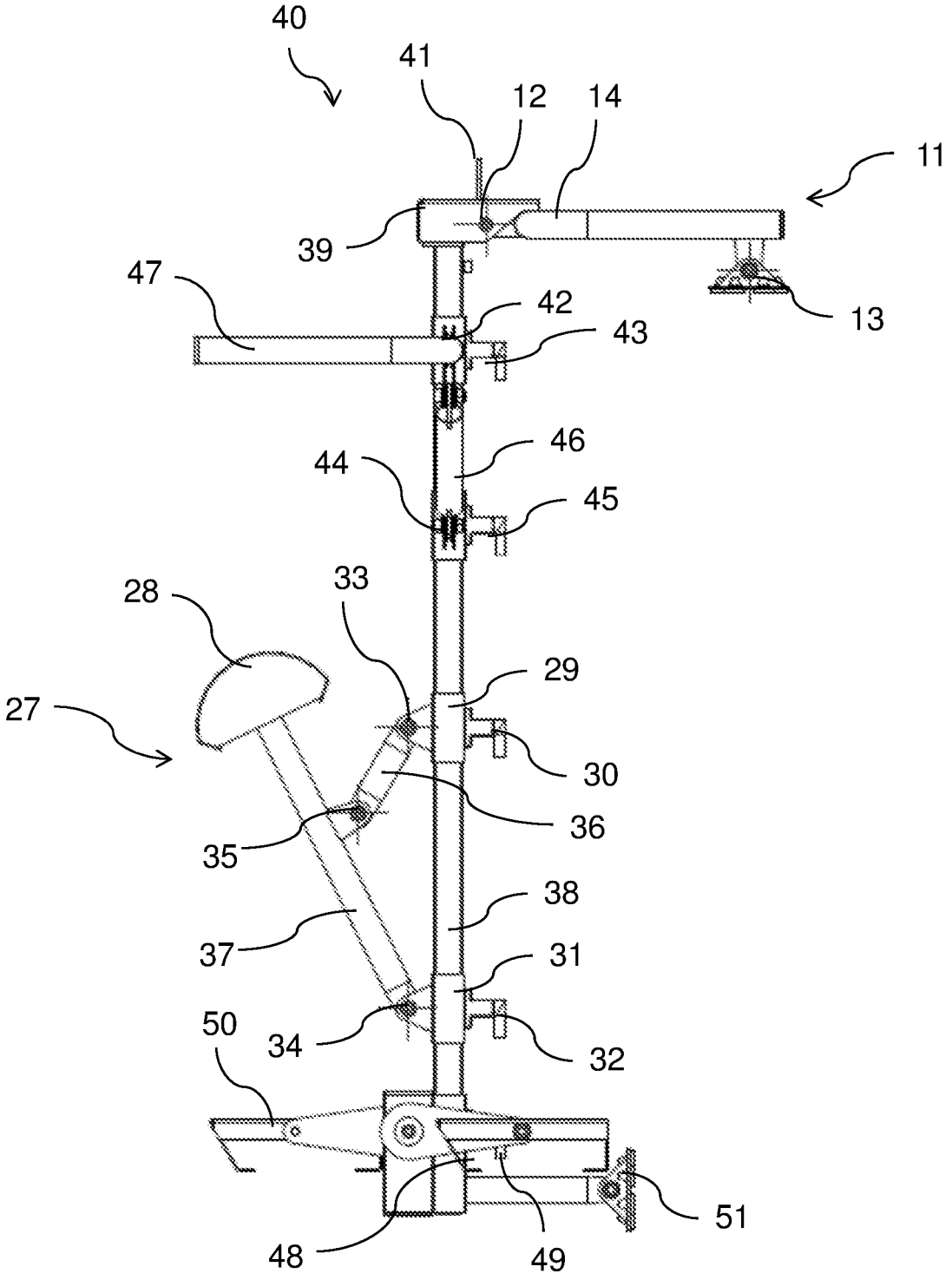
FIG. 5 represents, schematically and in a side view, a second particular embodiment of the seat device that is the subject of the invention.
Figure 6:
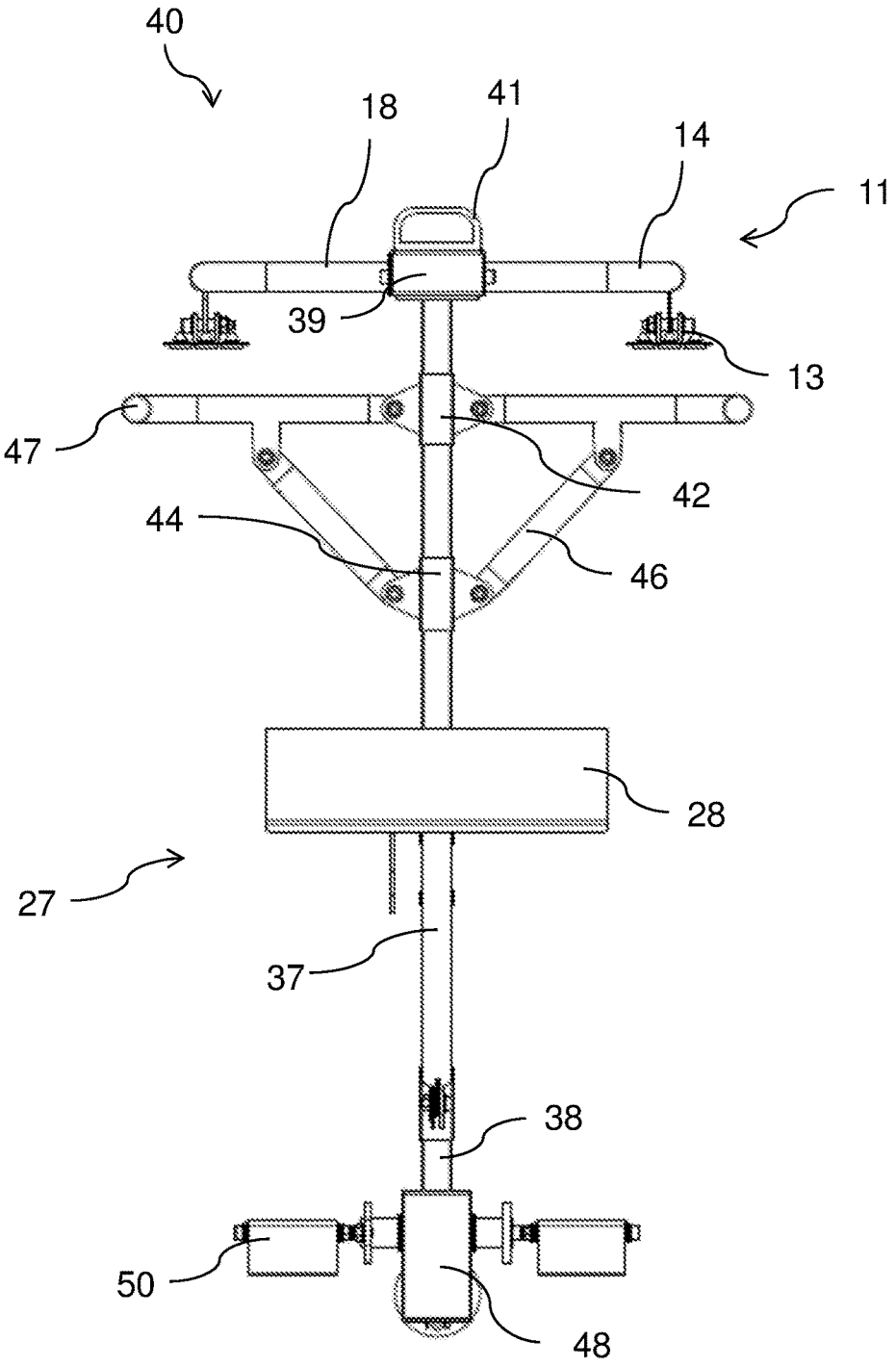
FIG. 6 represents, in a front view, the device shown in FIG. 5.
Figure 7:
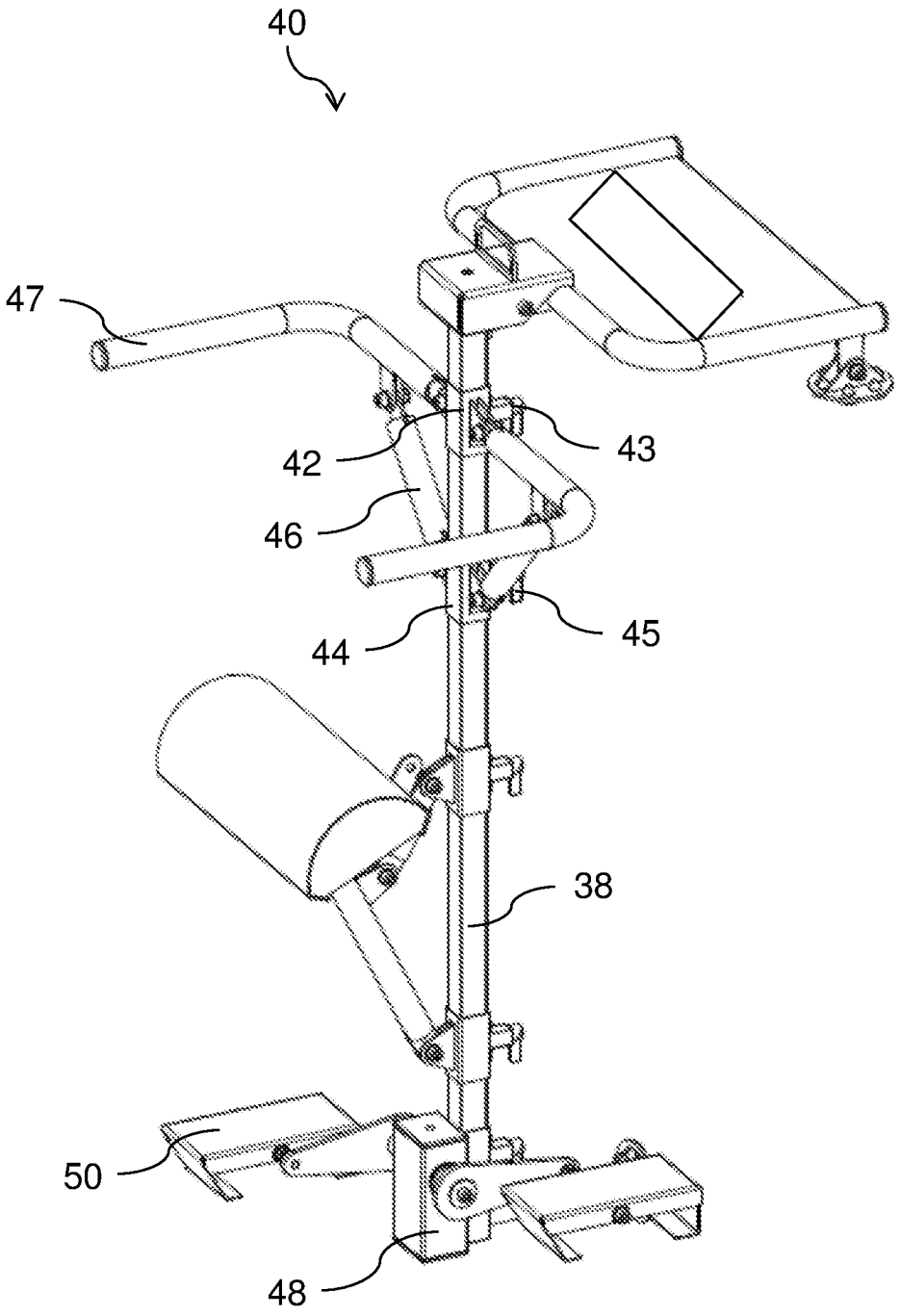
FIG. 7 represents, in perspective, the device shown in FIGS. 5 and 6.

It is now noted that the figures are not to scale.

FIGS. 1 to 4 show a seat device 10 comprising:

- a linear support 38;
- an upper bearing portion 11 configured to bear on a horizontal surface at the edge of a swimming pool (not shown);
- a lower bearing portion 19 configured to bear on an inner wall of the swimming pool; and
- a seat portion 27.

The seat portion 27 comprises:

- a seat 28;
- an upper seat rod 36, having one end provided with
  - a first seat slide 29 configured to slide along the linear support 38 and
  - a locking means 30 for locking the first slide 29 in position on the linear support 38;
- a lower seat rod 37, having one end provided with
  - a second seat slide 31 configured to slide along the linear support 38 and
  - a locking means 32 for locking the second slide 31 in position on the linear support 38.

In the embodiments shown in the figures, the linear support 38 is straight. In other embodiments, not shown, the linear support 38 is curved.

The two seat rods 36 and 37 jointly support the seat 28 and are connected to each other by a swivel link 35. In the embodiments shown, rod 37 bears the seat 28, at its upper extremity. The seat 28 has a broadly half-cylindrical shape whose flat surface is connected to the rod 37, for example by welding.

In this way, the seat slides 29 and 31 slide independently along the linear support 38. The joint sliding of the seat slides 29 and 31 modifies and adjusts the height of the seat 28. The respective sliding of the seat slides 29 and 31 adjusts at least the separation between the seat 28 and the linear support 38. In the embodiments shown in the figures, the respective sliding of the seat slides 29 and 31 modifies both the separation between the seat 28 and the linear support 38 and the height of the seat 28.

The upper seat rod 36 is connected to the slide 29 by a swivel link 33. The lower seat rod 37 is connected to the slide 31 by a swivel link 34. The different swivel links 33, 34 and 35 are, for example, threaded rods passing through one portion of one slide and one portion of one rod or through two portions of two rods, and free to rotate in these various portions.

In the first embodiment, the upper bearing portion 11 bearing on a horizontal surface at the edge of a swimming pool comprises, starting from the linear support 38:

- a connecting part 39 secured to the linear support 38 and bearing a shaft 12 and a handle 41;
- mounted in rotation on the shaft 12, two curved upper bearing means bearing articulated feet 13, each upper bearing means comprising a straight part 18 bearing an elbow 14 itself bearing a straight part 17, the straight parts 18 being coaxial and the straight parts 17 being parallel; and
- a shelf 16 secured to the upper bearing members.

The rotation of the upper bearing members around the shaft 12 towards the lower portion of the linear support 38 allows the overall dimensions of the device 10 to be reduced, for its storage. In the reverse direction, the rotation of the upper bearing members around the shaft 12 is limited to the position shown in FIGS. 1 to 4. In this position, the upper bearing means are in a plane perpendicular to the linear support 38.

In some embodiments (not shown), the shelf 16 can be folded independently of the upper bearing means and can reach an obtuse angle with regard to the linear support 38, to support a book, magazine or terminal in an inclined position and turned towards the head of the user.

The lower bearing portion 19 bearing on the wall of the swimming pool comprises a footrest 23 secured to a slide 20 provided with a locking means 21 and two bearing means or arms 25, each bearing an articulated foot 22. The sliding of the slide 20 on the linear support 38 allows the footrest 23 to be adjusted according to the height of the user and the position of the seat 28.

As shown in FIG. 1, the feet 13 are mounted on articulations forming a swivel link so the feet 13 can turn freely in the plane of FIG. 1 and be adjusted to the angle formed between the edge of the swimming pool and the horizontal. The feet 22 are mounted on articulations forming a swivel link so the feet 22 can turn freely in the plane of FIG. 4 and be adjusted to the unevenness of the wall of the swimming pool, for example in an angle of the swimming pool. The articulated feet 13 and 22 preferably have bearing surfaces made of flexible plastic material or rubber so as to not scratch or damage the edge and inner walls of the swimming pool.

Preferably, for locking the slides 29, 31 and 20 in position, the locking means 30, 32 and 21 comprise rods that sink and snap into openings, for example circular, of the linear support 38. These openings are preferably formed on the side of the linear support 38 intended to be turned towards the wall of the swimming pool, or towards the right in FIG. 1. In this way, the locking mechanisms of the slides resist the forces exerted by the user seated on the seat 28.

The handle 41 allows the device 10 to be carried without the user entering the water, when positioning the device 10 on the edge of the swimming pool, or removing it from the pool. Preferably, the handle 41 can be folded onto the surface of the connecting part 39. Preferably, the connecting part 39 has upper edges and upper corners that are rounded to avoid injuring the user who might press upon or fall onto this connecting part 39.

The various parts of the device 10 are preferably made of a non-rusting metal, for example stainless steel, with a natural finish. Alternatively, all or some of the parts of the device 10 are made of rigid plastic.

Preferably, when they are made of metal, the linear support 38, bearing means 11 and 19, and rods 36 and 37 are hollow tubes provided with an upper opening and a lower opening to favor the run-off of water.

The second embodiment 40 shown in FIGS. 5 to 9 includes the various parts of the first embodiment, except for the lower bearing portion 19, which is replaced by a pedal unit and a single bearing means on an inner wall of the swimming pool. In addition, the second embodiment 40 of the device comprises two parallel armrests 47. In this way, the second embodiment is more specifically designed to support the user in the relaxation position, back to the edge of the swimming pool, or in the exercise position, facing the edge of the swimming pool.

Figure 8:
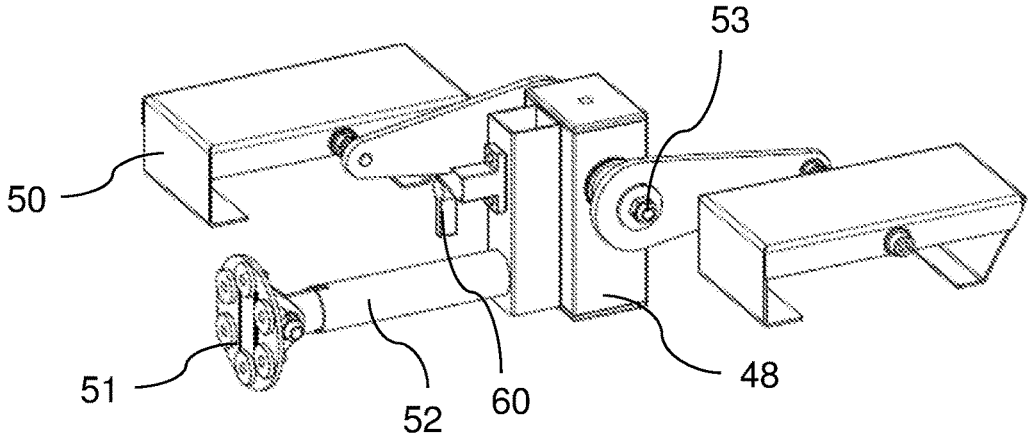
FIG. 8 represents, in perspective, the pedal unit of the device shown in FIGS. 5 to 7.

The lower portion of the device 40 is more specifically illustrated in FIG. 8. It comprises two pedals 50 mounted on a shaft 53 in rotation in a slide 48 sliding on the linear support 38 and provided with a locking means for locking in position 60. In addition, an arm 52 secured to the slide 48 bears a single foot 51 mounted on a swivel articulation permitting the foot 51 to rotate in the plane of FIG. 5. The arm 52 and the single foot 51 jointly reach a distance preferably at least five centimeters, and even more preferably at least ten centimeters, greater than the maximum distance reached by the pedals 50 during their movement.

Figure 9:
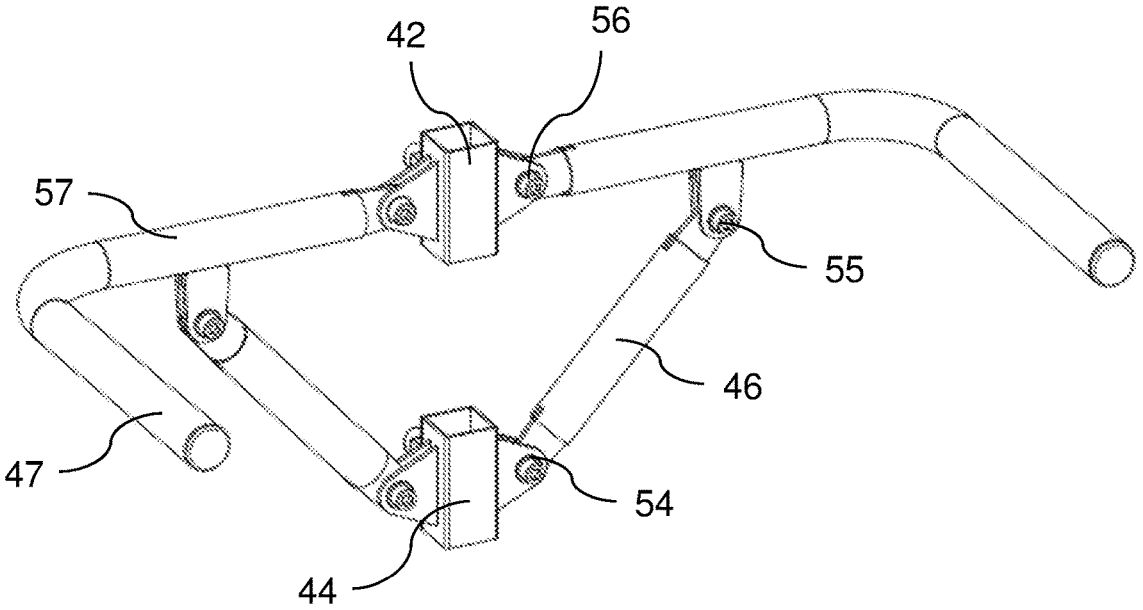
FIG. 9 represents, in perspective, a set of armrests of the device shown in FIGS. 5 to 8.

The armrest portion of the device 40 is more specifically illustrated in FIG. 9. Each armrest 47 is borne by:

an upper armrest rod 57, having one end provided with
- a first armrest slide 42 configured to slide along the linear support 38 and
- a locking means 43 (FIG. 7) for locking the first slide in position on the linear support 38;

a lower armrest rod 46, having one end provided with
- a second armrest slide 44 configured to slide along the linear support 38 and
- a locking means 45 (FIG. 7) for locking the second slide in position on the linear support.

The connection of the upper armrest rod 57 with the first armrest slide 42 is a pivot link 56. The connection of the lower armrest rod 46 with the second armrest slide 44 is a pivot link 54.

The two armrest rods 46 and 57 are connected to each other by a swivel link 55. Thanks to these different pivot links 54, 55 and 56, the armrest slides 46 and 57 slide independently along the linear support 38. In this way, the joint sliding of the armrest slides 46 and 57 modifies and adjusts the height of the armrest 47. The respective sliding of the armrest slides 46 and 57 modifies and adjusts at least the separation between the armrest 47 and the linear support 38.

The invention claimed is:

1. Adjustable seat device, comprising:

a linear support;

at least one upper bearing means of the linear support configured to bear on a horizontal surface at an edge of a swimming pool and at least one lower bearing means of the linear support configured to bear on an inner wall of the swimming pool;

a seat;

an upper seat rod, having one end provided with a first seat slide configured to slide along the linear support and a locking means for locking the first slide in position on the linear support;

a lower seat rod, having one end provided with a second seat slide configured to slide along the linear support and a locking means for locking the second slide in position on the linear support, the two seat rods jointly supporting the seat and being connected to each other by a swivel link, such that the seat slides slide independently along the linear support, the joint sliding of the seat slides adjusting the height of the seat and the respective sliding of the seat slides adjusting at least the separation between the seat and the linear support.

2. Device according to claim 1, wherein the linear support comprises openings which the locking means snap into.

3. Device according to claim 1, wherein each bearing means comprises an articulation of a foot.

4. Device according to claim 1, which comprises a foldable shelf.

5. Device according to claim 1, which comprises two armrests, each armrest being borne by:

an upper armrest rod, having one end provided with a first armrest slide configured to slide along the linear support and a locking means for locking the first slide in position on the linear support;

a lower armrest rod, having one end provided with a second armrest slide configured to slide along the linear support and a locking means for locking the second slide in position on the linear support, the two armrest rods being connected to each other by a swivel link, such that the armrest slides slide independently along the linear support, the joint sliding of the armrest slides adjusting the height of the armrest and the respective sliding of the armrest slides adjusting at least the separation between the armrest and the linear support.

6. Device according to claim 1 which comprises a pedal unit borne by the linear support.

7. Device according to claim 1, which comprises a single lower bearing means of the linear support on the wall of the swimming pool.

8. Device according to claim 1, wherein the linear support comprises an upper handle for transporting the device.

9. Device according to claim 1, which comprises a footrest fixed to the linear support.

10. Device according to claim 1, wherein at least one element of the assembly consisting of the linear support and the rods is a hollow tube, each hollow tube being provided with an upper opening and a lower opening.

* * * * *